US009790060B2

(12) United States Patent
Paβmann et al.

(10) Patent No.: US 9,790,060 B2
(45) Date of Patent: Oct. 17, 2017

(54) CRANE, IN PARTICULAR OVERHEAD CRANE OR GANTRY CRANE, COMPRISING AT LEAST ONE CRANE GIRDER

(71) Applicant: Terex MHPS GmbH, Düsseldorf (DE)

(72) Inventors: Christoph Paβmann, Dortmund (DE); Richard Kreisner, Ennepetal (DE); Thomas Schlierbach-Knobloch, Herdecke (DE)

(73) Assignee: Terex MHPS GmbH, Düsseldorf (DE)

( * ) Notice: Subject to any disclaimer, the term of this patent is extended or adjusted under 35 U.S.C. 154(b) by 134 days.

(21) Appl. No.: 14/432,682

(22) PCT Filed: Oct. 4, 2013

(86) PCT No.: PCT/EP2013/070751
§ 371 (c)(1),
(2) Date: Mar. 31, 2015

(87) PCT Pub. No.: WO2014/056808
PCT Pub. Date: Apr. 17, 2014

(65) Prior Publication Data

US 2015/0259179 A1 Sep. 17, 2015

(30) Foreign Application Priority Data

Oct. 9, 2012 (DE) ..... 10 2012 109 588

(51) Int. Cl.
*B66C 19/00* (2006.01)
*B66C 6/00* (2006.01)

(52) U.S. Cl.
CPC ..... *B66C 6/00* (2013.01); *B66C 19/00* (2013.01)

(58) Field of Classification Search
CPC .... B66C 5/00; B66C 5/02; B66C 5/04; B66C 5/06; B66C 6/00; B66C 7/00; B66C 7/08;
(Continued)

(56) References Cited

U.S. PATENT DOCUMENTS

| | | | |
|---|---|---|---|
| 327,360 | A | 9/1885 | Vanes |
| 7,503,460 | B1 | 3/2009 | Petricio Yaksic |
| 2011/0247993 | A1 | 10/2011 | Chernyak |

FOREIGN PATENT DOCUMENTS

| | | |
|---|---|---|
| CN | 202465064 | 10/2012 |
| DE | 260030 | 5/1913 |

(Continued)

OTHER PUBLICATIONS

International Search Report and Written Opinion for corresponding PCT Application No. PCT/EP2013/070751 dated Apr. 12, 2013.

(Continued)

*Primary Examiner* — Sang Kim
*Assistant Examiner* — Juan Campos, Jr.
(74) *Attorney, Agent, or Firm* — Gardner, Linn, Burkhart & Flory, LLP

(57) ABSTRACT

The invention relates to a crane, in particular an overhead crane or gantry crane, having at least one crane girder that extends horizontally in a longitudinal direction. The crane is designed as a trussed girder and comprises struts which connect an upper run and a lower run together. The upper run and lower run of the trussed girder are designed in a laminar manner, on which a crane trolley having a lifting gear can be moved. The at least one crane girder is advantageously improved by virtue of the fact that the struts are designed in a laminar manner, each strut has a main surface that extends transversely with respect to the longitudinal direction of the crane girder. The first or second strut end of each strut has at least one aperture on the main surface that lies against the lower run or the upper run.

20 Claims, 5 Drawing Sheets

(58) Field of Classification Search
CPC ..... B66C 11/00; B66C 11/14; B66C 17/00–17/26; B66C 19/00; B66C 19/002; B66C 19/005; B66C 19/007; B66C 19/02; B61B 13/04; B61B 5/02; E01B 25/08; E01B 25/10; Y10T 29/49634
USPC ..... 104/118–121
See application file for complete search history.

(56) References Cited

FOREIGN PATENT DOCUMENTS

| | | |
|---|---|---|
| DE | 1095486 | 12/1960 |
| DE | 1218679 | 6/1966 |
| DE | 1971794 | 11/1967 |
| DE | 1907455 | 10/1969 |
| DE | 6604483 | 1/1970 |
| DE | 2239573 | 9/1973 |
| DE | 2419678 | 11/1975 |
| DE | 3222307 | 12/1983 |
| DE | 3731245 | 3/1989 |
| DE | 102012102808 | 3/2012 |
| EP | 0928769 | 7/1999 |
| FR | 1391167 | 1/1965 |
| FR | 2478606 | 9/1981 |
| NL | 278615 | 7/1964 |

OTHER PUBLICATIONS

English Translation of International Preliminary Report on Patentability for corresponding PCT Application No. PCT/EP2013/070751, dated Apr. 12, 2013.
Co-pending and commonly-owned U.S. Appl. No. 14/433,076, filed Apr. 2, 2015.

CRANE, IN PARTICULAR OVERHEAD CRANE OR GANTRY CRANE, COMPRISING AT LEAST ONE CRANE GIRDER

CROSS-REFERENCE TO RELATED APPLICATIONS

This application claims the benefit of International Application No. PCT/EP2013/070751, filed on Oct. 4, 2013, and also of German Application No. 10 2012 109 588.4, filed on Oct. 9, 2012, both of which are incorporated herein by reference in their entireties.

FIELD OF THE INVENTION

The present invention relates to a crane, in particular an overhead crane or gantry crane.

BACKGROUND OF THE INVENTION

German patent specification DE 260030 discloses a so-called double-girder gantry crane having two horizontal crane girders and two vertical support girders which form a gantry frame of the gantry crane. The crane girders extend in parallel and at a spaced interval with respect to each other. Arranged at each of the lower ends of the support girders is a travelling mechanism, by means of which the gantry crane can be moved in a direction of travel extending transversely with respect to the longitudinal direction of the crane girders. A crane trolley having a cable winch can be moved on and along the crane girders. According to the design as a double-girder crane, a load picking-up means of the cable winch arranged on the crane trolley is lowered or raised between the two crane girders. The crane girders are formed as trussed girders and comprise in each case an upper run and a lower run which are each oriented horizontally and in parallel with each other. The upper and lower runs of the two crane girders are connected to one another by means of vertically extending, rod-shaped posts and diagonally extending, rod-shaped struts. The two crane girders are connected to one another at their ends by means of transverse rods and struts to form a frame. Rod-shaped posts and struts are provided along the longitudinal direction of the crane girders between the upper and lower run as a type of truss and each connect an upper run to the lower run arranged vertically therebelow.

German utility model document DE 1 971 794 U describes a double-girder overhead crane whose two horizontal crane girders are connected to one another by means of head girders arranged at the respective ends thereof and can be moved together in a direction of travel extending transversely with respect to the longitudinal direction of the crane girders. Both crane girders are designed in a similar manner as trussed girders and comprise in each case plate-shaped upper runs, rod-shaped lower runs and rod-shaped posts.

German laid-open document DE 2 239 573 A discloses a trussed girder, of which the upper run and the lower run are connected together via struts. The struts are designed as angle profiles, of which the lower ends comprise a slot and are screwed to the lower run.

German patent specification DE 10 95 486 B discloses a crane girder which is designed as a trussed girder and of which the struts which connect the upper run and lower run to one another are formed by rod-shaped T-profiles. The rod-shaped struts comprise at their ends recessed flanges with which they lie against the upper run in the manner of a joint, whereas the webs lie on the upper run.

European patent application EP 0 928 769 A1 describes a crane girder which is designed as a trussed girder, against the upper run and lower run of which angular struts having an L-shaped cross-section lie. The L-shaped cross-section of the angular struts is formed by a main surface extending in the longitudinal direction of the crane girder and by an auxiliary surface adjoining thereto and folded by 90 degrees. The auxiliary surface comprises an aperture which is arranged in the region of the upper run.

U.S. Pat. No. 7,503,460 B1 discloses a crane girder which is designed as a trussed girder and has rod-shaped struts composed of two strut profiles. In this case, the strut profiles are arranged spaced apart from one another by spacers. In each case, a plate connected to an upper run or a plate connected to a lower run is pushed and welded between the ends of the strut profiles.

Chinese document CN 202 465 064 U also discloses composite struts of a trussed girder which each comprise a pair of mutually spaced apart U-profiles. The U-profiles are fastened on both sides with their ends to a plate-shaped web of the lower run which is arranged between the ends of each pair of U-profiles.

SUMMARY OF THE INVENTION

The present invention provides a crane, in particular an overhead crane or gantry crane, having at least one improved crane girder. The crane has at least one crane girder which extends horizontally in a longitudinal direction, is designed as a trussed girder and comprises struts which connect an upper run and a lower run together and are designed in a laminar manner, on which girder a crane trolley having a lifting gear can be moved.

According to one aspect of the invention, a crane, in particular an overhead crane or gantry crane having at least one crane girder, which extends horizontally in a longitudinal direction, is designed as a trussed girder and includes struts that connect an upper run and a lower run together. The upper run and lower run of the trussed girder are designed in a laminar manner, on which a crane trolley having a lifting gear can be moved. The at least one crane girder is advantageously improved by virtue of the fact that the struts are designed in a laminar manner, each strut having a main surface that extends transversely with respect to the longitudinal direction of the crane girder. The first or second strut end of each strut has at least one aperture on the main surface that lies against the lower run or the upper run.

In this case, struts are generally considered to be those elements of a trussed structure that extend in an oblique or diagonal manner. As a result, the struts of the trussed structure differ from the elements that extend exclusively vertically and are defined as posts.

In contrast to conventional crane girders in the trussed girder design, the improved crane girders can reduce the manufacturing outlay, since in the case of struts or posts produced from sheet steel, corresponding apertures can be produced in a particularly simple manner e.g. by laser cutting. Furthermore, a reduction in the diversity of parts and a substantial simplification of assembly associated therewith are achieved, in that by virtue of the apertures provided in the struts a type of self-orientation or self-adjustment of the struts with respect to the lower run or upper run is accomplished. The particularly simple adjustment of the struts with respect to the lower run or upper run is effected by introducing or inserting the lower run or upper run into the aperture of the strut or by attaching the strut onto the lower run or upper run, whereby they engage one another and are moved into abutment against one another. The relative position of the lower run or upper run with respect to the struts can hereby be fixed in a simple manner in translatory terms. Prior to welding the lower run or the upper run to the struts, only a rotatory orientation of the struts then has to be performed, to adjust the desired vertical spaced interval of the lower run from the upper run.

The laminar struts or surface struts preferably absorb forces in the direction of their longitudinal axis and thus in the extension plane of their planar main surface. Such surface elements or surface support structures are defined in engineering mechanics as disks, whereas surface elements which are loaded perpendicularly to their extension plane or main surface are defined as plates. Disks, and thus also the surface struts, in accordance with the invention differ (e.g. from rods or rod-shaped posts and struts) by virtue of the fact that their thickness dimensions are substantially smaller than the length and width dimensions that determine the planar extension of the disk. Accordingly, laminar struts can also be defined as surface struts or disk struts.

Moreover, due to the omission of statically unnecessary sheet metal regions and a saving in material associated therewith, the crane girders produced with laminar struts as a trussed girder have a considerably reduced intrinsic weight and at the same time optimised load-bearing capacity.

The fact that each aperture is arranged in the main surface of the struts also makes simple manufacture possible. Therefore, the apertures can already be produced when cutting the sheet metal profile to size.

Precise orientation is advantageously simplified by virtue of the fact that each aperture is arranged in a main surface of the struts that extends transversely with respect to the longitudinal direction.

In a particularly advantageous manner, it is provided that the struts can be positioned in a positive-locking manner relative to the lower run or the upper run by the aperture. The positive-locking connection serves to further simplify the orientation of the struts with respect to the lower run or upper run prior to final welding.

In a structurally simple design, it is provided that the struts are connected to the lower run or the upper run by the aperture.

Final assembly is simplified by virtue of the fact that the struts are welded to the lower run or the upper run in the region of the aperture.

The aforementioned advantages are utilized in a particularly effective manner by virtue of the fact that the lower first strut end is provided with a lower aperture, against which the lower run lies, and the upper second strut end is provided with an upper aperture, against which the upper run lies.

In a structurally simple design, it is provided that the upper run and the lower run each have at least one vertical web and the web of the upper run lies against an upper aperture and the web of the lower run lies against a lower aperture. This simplifies the manner in which the lower and the upper run are inserted one inside the other with the apertures of the struts.

A further simplification in assembly and a reduction in weight can be achieved by virtue of the fact that the upper run has two upper run profiles each having a web or the lower run comprises two lower run profiles each having a web.

The orientation of the struts with respect to the lower run and the upper run is further simplified by virtue of the fact that precisely one aperture is provided for each web.

In a structurally simple embodiment, it is also possible that two webs of the upper run have a common upper aperture and two webs of the lower run have a common lower aperture.

In a structurally simple form, it is provided that the struts have at least one auxiliary surface that is folded at a right angle from the main surface. This increases in particular the buckling strength of the struts.

An effective positive-locking connection between the lower run or upper run and the struts or the apertures thereof is achieved by virtue of the fact that at least one of the apertures is formed in the shape of a slot and is arranged between the longitudinal sides of the respective main surface.

In a structurally simple design, it can also be provided that at least two of the apertures are formed in the shape of a shoulder and are arranged opposite one another on the longitudinal sides of the respective main surface.

Moreover, it is advantageous in terms of manufacturing technology that the web of the lower run or the web of the upper run is welded to at least one longitudinal side of the corresponding aperture, which longitudinal side extends in parallel with a longitudinal axis of the struts. By welding the longitudinal sides of the apertures, the connections on the longitudinal sides of the main surfaces have corresponding webs of the upper run or lower run and form a type of membrane joint which, as seen in the longitudinal direction of the struts, are arranged between the respective aperture and auxiliary surfaces that are folded from the main surfaces.

The risk of the upper run or the lower run buckling is reduced in a particularly effective manner by virtue of the fact that the upper run and the lower run are connected to one another by means of a plurality of posts arranged along the longitudinal direction of the crane girder, wherein the posts, like the struts, are designed in a laminar manner having at least one aperture. The load-bearing capacity of a corresponding overhead or gantry crane or the crane girder thereof is also achieved hereby.

These and other objects, advantages and features of the invention will become apparent upon review of the following description in conjunction with the drawings.

DESCRIPTION OF THE PREFERRED EMBODIMENTS

Figure 1A:
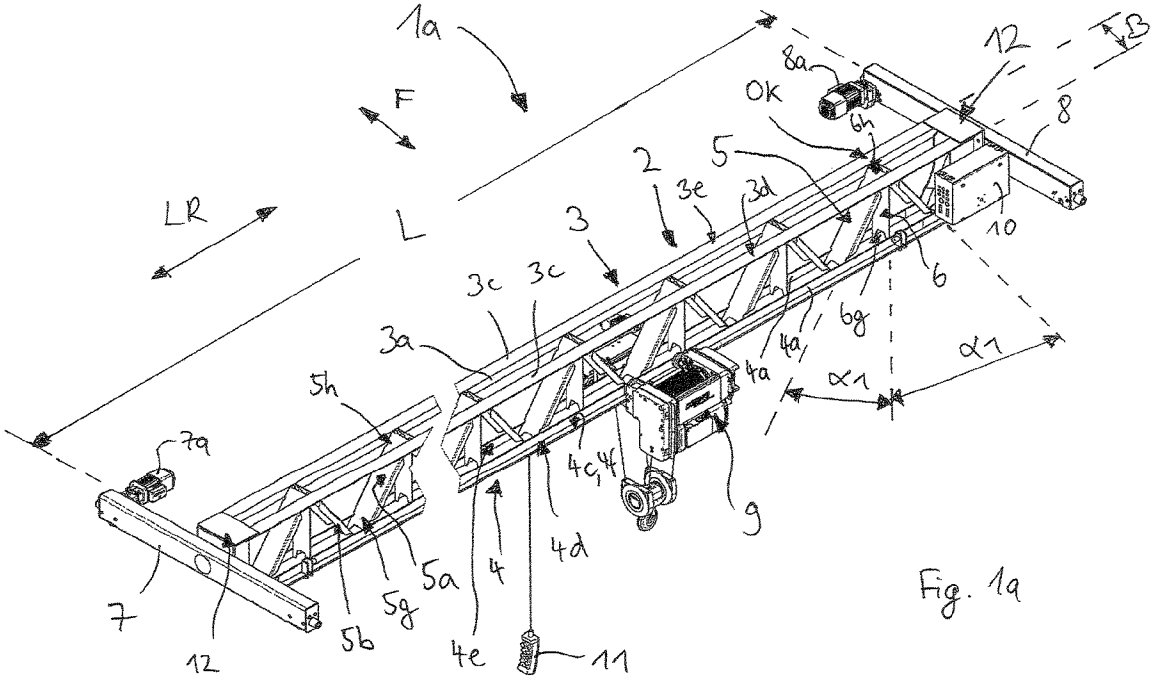
FIG. 1*a* is a top perspective view of an overhead crane that is designed as a present invention.
Figure 1B:
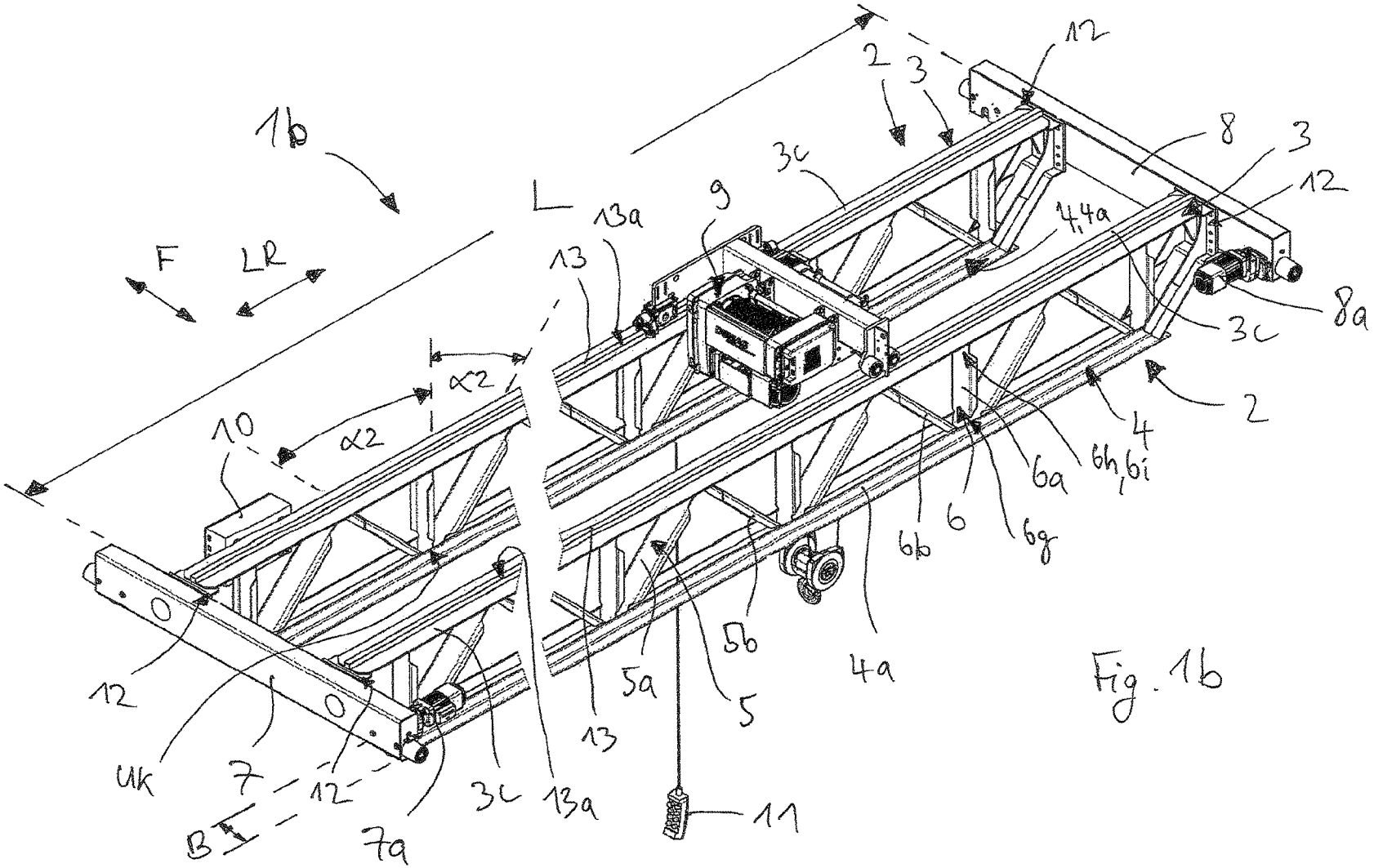
FIG. 1*b* is a top perspective view of an overhead crane that is designed as a double-girder crane and has two crane girders in accordance with the present invention.
Figure 2:
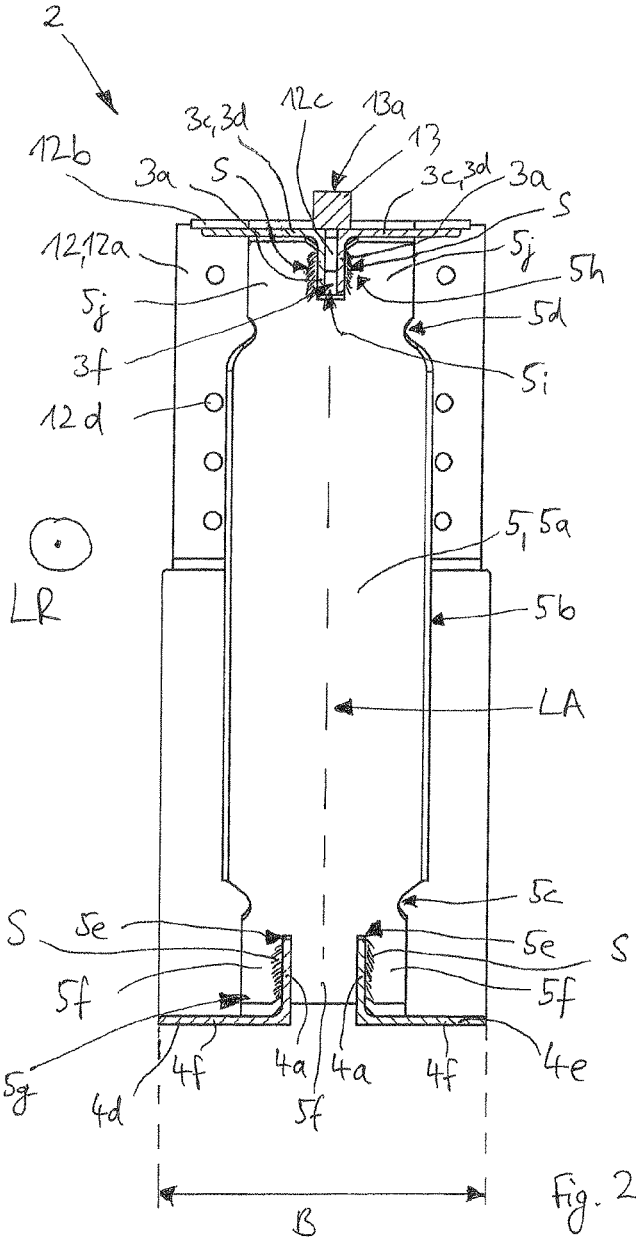
FIG. 2 is a cross-sectional view of one of the crane girders for an overhead crane designed as a single or double-girder crane.

Referring now to the drawings and the illustrative embodiments depicted therein, a first crane 1*a* is designed as a single-girder overhead crane. It will be appreciated that the explanations given hereinafter with reference to overhead cranes also apply accordingly to gantry cranes. The first crane 1*a* includes a crane girder 2 that is designed as a trussed girder and is oriented horizontally and extends with a length L in its longitudinal direction LR. First and second travelling mechanisms 7, 8 are fastened to the opposite ends of the crane girder 2, so that a crane bridge is formed that is substantially I-shaped as seen in plan view (FIGS. 1-2). The first crane 1*a* can be moved, using travelling mechanisms 7,8, in a horizontal direction of travel F transversely with respect to the longitudinal direction LR of the crane girder 2 on rails, not illustrated. The rails are typically arranged in a position above the ground and for this purpose can be elevated e.g. by means of a suitable support structure or can be fastened to opposite building walls. In order to move the first crane 1*a* or its crane girder 2, the first travelling mechanism 7 is driven by a first electric motor 7*a* and the second travelling mechanism 8 is driven by a second electric motor 8*a*. Suspended from the crane girder 2 is a crane trolley 9 that has a lifting gear designed as a cable winch and can be moved by the travelling mechanisms, not illustrated, transversely with respect to the direction of travel F of the first crane 1*a* and along the longitudinal direction LR of the crane girder 2. The crane trolley 9 can be moved along and on laterally protruding running surfaces 4*c* of a lower run 4 of the crane girder 2. The first crane 1*a* includes and is controlled by a crane controller 10 and a pendant control switch 11 that is connected thereto. The first crane 1*a*, the electric motors 7*a*, 8*a*, and the crane trolley 9 with the cable winch can be controlled and operated separately from one another by the crane controller 10 and pendant control switch 11.

The trussed structure of the crane girder 2 substantially includes an upper run 3, a lower run 4, diagonally extending struts 5 and vertical posts 6. The upper run 3 and the lower run 4 extend in each case for the most part in a linear manner, spaced apart from one another and, with the exception of the opposite ends of the crane girder 2, in parallel in the longitudinal direction LR of the crane girder 2 between the travelling mechanisms 7, 8. In this case, the upper run 3 and the lower run 4 are vertically spaced apart from one another. The upper run 3 is composed of two first and second upper run profiles 3*d*, 3*e* that are arranged in a horizontal plane and are horizontally spaced apart from one another.

The two upper run profiles 3*d*, 3*e* are formed by an L- or angle-profile girder, and each upper run profile 3*d*, 3*e* includes a vertical web 3*a* and a horizontal flange 3*c* that are arranged at a right angle thereto. Like the upper run 3, the lower run 4 is likewise composed of two L- or angle profile girders, namely a first lower run profile 4*d* and a second lower run profile 4*e*. Each lower run profile 4*d*, 4*e* thus includes a horizontal flange 4*f* and a vertical web 4*a* that are arranged at a right angle to one another accordingly. The downwardly directed webs 3*a* of the upper run profiles 3*d*, 3*e* of the upper runs 3 and the upwardly directed webs 4*a* of the lower run profiles 4*d*, 4*e* of the lower runs 4 face towards one another. Moreover, the spaced interval of the outermost edges of the flanges 3*c*, 4*f* of the upper run profiles 3*d*, 3*e* or of the lower run profiles 4*d*, 4*e* of the lower run 4, as seen in the longitudinal direction LR, produces or defines a width B of the crane girder 2.

However, it is likewise possible that the lower run 4 of the crane girder 2 of a first crane 1*a* may be designed as a single-girder overhead crane that is not formed by two lower run profiles 4*d*, 4*e* but rather by a flat profile having two webs standing perpendicularly, similar to webs 4*a* described above. In the case of such a flat profile, which includes an approximately U-profile-shaped cross-section, the flange 4*f* is extended laterally beyond the webs 4*a*. In this case, the opposite ends of the flange 4*f* form the running surfaces 4*c*.

Alternatively, the lower run 4 can also be formed by an upside down T-profile girder that includes a web 4*a* pointing vertically upwards. Corresponding to the inverted T-shape, the web 4*a* of the T-profile girder is connected by its lower end centrally to a horizontal flange 4*f*. In this case, the opposite ends of the flange 4*f* each form a running surface 4*c* for travelling mechanisms of the crane trolley 9.

The upper run 3 and the lower run 4 are connected to one another by a plurality of struts 5 and posts 6 that are designed in a laminar manner. In this case, the struts 5 are formed as a sheet metal profile having a main surface 5*a* with a substantially rectangular cross-section, wherein the longitudinal sides thereof are overturned in the form of auxiliary surfaces 5*b* to increase the buckling strength at least in a central region. The basic structure of the laminar posts 6 corresponds—in the case of correspondingly adapted dimensions—substantially to the structure of the laminar struts 5. In this case, each of the laminar posts 6 extends with a main surface 6*a* transversely with respect to the longitudinal direction LR of the crane girder 2. In addition, auxiliary surfaces 6*b* can be provided that are folded at a right angle with respect to the main surface 6*a* and extend in the longitudinal direction LR (FIG. 1*b*). The laminar posts 6 can also be arranged or oriented in such a manner that the auxiliary surfaces 6*b* point towards or away from one of the ends of the crane girder 2.

The structure of the struts 5 and the posts 6 is will be described in detail hereinafter with reference to FIG. 2.

The trussed structure of the crane girder 2 is terminated at each opposite end of the upper run 3 and of the lower run 4 by an adapter 12. Using the adapters 12, the upper run 3 and the lower run 4 are connected to form a frame. On the whole, the frame of the crane girder 2 is extended from the bottom to the top and is formed in a trapezoidal manner. Moreover, in the region of the upper run 3 and on the side facing away from the upper run 3, the adapter 12 includes a connecting plate 12*a*, to which one of the travelling mechanisms 7, 8 or the girder thereof is fastened via bores 12*d*.

Starting from one of the two adapters 12 as seen in the longitudinal direction LR of the crane girder 2, a first strut 5 is connected to the lower run 4 and extends in the longitudinal direction LR inclined at a first setting angle $\alpha 1$ in the direction of the upper run 3 and is fastened at that location in an upper node point OK. In this case, the first setting angle $\alpha 1$ is enclosed by the first strut 5 and a post 6 terminating in the upper node point OK. Preferably, the first setting angle $\alpha 1$ is in a range of 35 degrees to 55 degrees and in a particularly preferred manner is 45 degrees. In the upper node point OK, a second strut 5 extends obliquely from the upper node point OK at the setting angle $\alpha 1$ downwards to the lower run 4. This is repeated until the struts 5 reach the opposite end of the crane girder 2. Therefore, each strut 5 together with post 6 forms, in the region of the corresponding upper node point OK on the upper run 3, a first setting angle $\alpha 1$ of the same size. In this case, an even number of struts 5 are arranged in the manner of a pitched roof obliquely or diagonally with respect to one another is always used, so that the last strut 5 terminates at the lower run 4. The setting angle $\alpha 1$ is determined prior to assembly, depending upon the length L of the crane girder 2, so that an even number of struts 5 is used that each have the same length and are at the same setting angle $\alpha 1$. As a consequence, the lower run 4, which serves as a rail and for this purpose forms the running surface 4*c*, is reinforced to protect it against bending.

The struts 5 are oriented within the trussed structure of the crane girder 2 such that in each case their main surface 5*a* extends transversely with respect to the longitudinal direction LR of the crane girder 2. Moreover, the struts 5 are arranged and placed with their lower first strut ends 5*g* between the mutually facing inner sides of the webs 4*a* of the lower run profiles 4*d*, 4*e* and are welded thereto. For this purpose, lower aperture 5*e*, which is not illustrated in FIG. 1*a*, is arranged in each case on the lower first strut ends 5*g* in the corner region of both longitudinal sides of the struts 5. The formation of the lower apertures 5*a* corresponds to that illustrated in detail in FIG. 3*b* in conjunction with the crane girder 2 for an overhead crane designed as a double-girder crane. In the region of the lower apertures 5*e*, the longitudinal sides are set back approximately by the thickness dimension of a web 4*a* in the direction of the longitudinal axis LA of the strut 5. The webs 4*a* of the lower run profiles 4*d*, 4*e* are placed in the shoulder thus produced. In this case, the horizontal flanges 4*f* of the lower run profiles 4*d*, 4*e* each point outwards and thus away from the struts 5.

In the case of lower run 4 that is designed as a T-girder, the struts 5 are attached with their lower first strut ends 5*g* onto the upwardly pointing web 4*a* of the lower run 4. In this case, the web 4*a* is received by a lower aperture 5*e* that is provided in the region of the lower first strut end 5*g* and is formed to be substantially complementary to the web 4*a*. Accordingly, the lower aperture 5*e* is arranged along a longitudinal axis LA of the strut 5 and in relation to a width of the main surface 5*a* of the strut 5 centrally therein. By inserting the web 4*a* of the lower run 4 into the lower aperture 5*e* of the strut 5, the lower run 4 and the strut 5 are thus positioned with respect to one another.

In a corresponding manner, in the case of lower run 4 that is designed as flat profile or consists of two lower run profiles 4*d*, 4*e*, the two webs 4*a* can be received by two lower apertures 5*e* that are arranged in the main surface 5*a* of each strut 5, and which can be arranged not only in the corner region, but also between the longitudinal sides of the strut 5 and the longitudinal axis LA thereof in the main surface 5*a* (see FIG. 2).

At their upper second strut ends 5*h*, the struts 5 are arranged between the two upper run profiles 3*d*, 3*e*, wherein the upper run profiles 3*d*, 3*e* are welded with the inner sides of their webs 3*a* to the struts 5. For this purpose, in a similar manner to the lower apertures 5*e*, corresponding upper apertures 5*i*, not illustrated in FIG. 1*a*, are arranged on the longitudinal sides of the upper second strut end 5*h*, in which the webs 3*a* are located. In this case, the horizontal flanges 3*c* of each of the upper run profiles 3*d*, 3*e* point outwards and thus away from the struts 5.

The laminar posts 6 are arranged in the same manner as the struts 5 with their lower first post end 6*g* and their upper second post end 6*h* between the webs 3*a*, 4*a* of the upper run 3 or lower run 4 and are welded thereto. For this purpose, the posts 6 also include, on the longitudinal sides of their main surfaces 6*a*, corresponding lower apertures 6*e* and upper apertures 6*i*.

In the case of lower run 4, which is designed as a T-girder, the posts 6 are slid with their lower first post ends 6*g* or lower aperture 6*e* disposed therein onto the web 4*a* of the lower run 4 and are welded thereto. The same applies in the case of upper run 3, which is designed as a T-girder, for the upper second post end 6*h*.

As seen transversely with respect to the longitudinal direction LR of the crane girder 2, only one strut 5 and one post 6 are ever provided between the webs 3*a* of the upper run 3.

FIG. 1*b* shows second crane 1*b* that is designed as a double-girder overhead crane and includes two crane jibs 2 in comparison with the first crane 1*a* designed as a single-girder overhead crane. The two crane girders 2 are adjusted to the desired length L and arranged spaced apart from another in parallel using adapters 12 that are slid on at their opposite ends. The travelling mechanisms 7, 8, which are also illustrated, are fastened to the ends of the two crane girders 2 using the adapters 12, so that a frame is formed as seen in plan view. The second crane 1*b* also includes a crane trolley 9 having a lifting gear designed as a cable winch. However, the crane trolley 9 is not suspended from the lower runs 4 of the crane girders 2 but rather runs on upper runs 3 of the two crane girders 2. For this purpose, rail 13 having a corresponding running surface 13*a* is provided, preferably centrally, on each of the two upper runs 3, so that the crane trolley 9 is arranged between the crane girders 2. Accordingly, the crane trolley 9, which is arranged centrally between the crane girders 2, is moved along the longitudinal direction LR of the crane girders 2 and between the two crane girders 2 and between the travelling mechanisms 7, 8. In this case, the cable winch is arranged on the crane trolley 9 to lower and raise a load between the two crane girders 2.

For the remainder, the statements given with respect to the first crane 1*a* apply accordingly for the second crane 1*b*.

The trussed structures of the two crane girders 2 of the second crane 1*b* include, again, lower run 4 and upper run 3. The upper runs 3 and the lower runs 4 are designed in the same manner as in the case of the first crane 1*a*, shown in FIG. 1*a*, and accordingly are composed of a first and second upper run profile 3*d*, 3*e* and first and second lower run profile 4*d*, 4*e*, wherein the upper run profiles 3*d*, 3*e* and lower run profiles 4*d*, 4*e* are formed by an L- or angle-profile girder.

However, instead of being composed of two lower run profiles 4*d*, 4*e* the lower run 4 of the second crane 1*b* can essentially also consist of a flat profile or of an upside down T-profile girder.

The upper run 3 of each crane girder 2 is connected to the associated lower run 4 by the plurality of laminar struts 5 and the plurality of likewise laminar, vertically oriented posts 6. The struts 5 and the posts 6 are identical in each case for the two crane girders 2 of the second crane 1*b*, i.e., as in the case of the first crane 1*a* shown in FIG. 1*a*, they are designed in a mirror-symmetrical manner in relation to their longitudinal axis LA.

Furthermore, it is evident in FIG. 1*b* that the struts 5 are arranged in the manner of a pitched roof in the same manner as in the case of the crane girder 2 shown in FIG. 1*a*. In this case, two adjacent struts 5 are likewise allocated one post 6, which is designed in a laminar manner, such that struts 5 and the post 6 impinge upon one another at a common lower node point UK on the lower runs 4. Therefore, each strut 5, together with the associated laminar post 6 in the region of the corresponding lower node point UK on the lower runs 4, forms an identically large second setting angle $\alpha 2$, which just like the first setting angle $\alpha 1$, is preferably in a range of 35 degrees to 55 degrees and in a particularly preferred manner is 45 degrees. Therefore, by reason of the even number of struts 5 arranged correspondingly in pairs, the last strut 5 descends towards the lower run 4 at both ends of the crane girder 2. However, unlike in the case of the crane girder 2 shown in FIG. 1*a*, laminar post 6 is also arranged at each end of the crane girder 2 after the last strut 5. Moreover, auxiliary surfaces 6*b* are provided that are folded differently compared to the posts 6 shown in FIG. 1*a*. For each crane girder 2, the auxiliary surfaces 6*b* are folded in the same direction towards the same end of the crane girder 2, but in the case of one of the crane girders 2 they are folded towards the first travelling mechanism 7, and in the case of the other one of the crane girders 2 they are folded towards the second travelling mechanism 8.

FIG. 2 shows a cross-sectional view of one of the two crane girders 2 for an overhead crane that is designed as a double-girder crane. FIG. 2 shows in particular the basic structure of the struts 5 that corresponds substantially to the basic structure of the posts 6, which are likewise designed in a laminar manner, but can differ therefrom in particular in terms of dimensions. The statements in relation to FIG. 2 also apply to the crane girder 2 of an overhead crane designed as a single-girder crane, as shown in FIG. 1*a*. For the sake of simplicity, with respect to the description of FIG. 2 reference is made only to the struts 5; the reference numerals 5*a* to 5*j* mentioned in this case similarly designate the corresponding elements of the laminar posts 6, which are indicated at the same points as reference numerals 6*a* to 6*j* and are listed in the list of reference numerals.

The strut 5 illustrated in FIG. 2 and designed in a laminar manner includes an elongated shape having a substantially rectangular main surface 5*a*. The main surface 5*a* extends along the longitudinal axis LA of the strut 5, and in each case in a central region over at least half the width B of the crane girder 2 in a transverse manner with respect to the longitudinal direction LR of the crane girder 2. The struts 5 are produced preferably by laser cutting from a steel sheet. Moreover, the struts 5 have lower first strut end 5*g* and upper second strut end 5*h*. In the region of their opposite lower first and upper second strut ends 5*g*, 5*h*, two lower recesses 5*c* and two upper recesses 5*d* are provided on both longitudinal sides of the strut 5. The recesses 5*c*, 5*d* are circular, preferably circular arc-shaped, in formation and, with regard to the welding of the struts 5 to the upper run 3 or the lower run 4 of the crane girder 2, ensure that the distribution of forces is optimized by the welded struts 5 and the weld seams S or the weld seam run-outs are relieved.

Between the lower and upper recesses 5*c*, 5*d*, auxiliary surface 5*b*, which is folded at a right angle and extends in parallel with the longitudinal axis LA, adjoins the main surface 5*a* at each longitudinal side of the strut 5. The auxiliary surfaces 5*b* are formed substantially in a trapezoidal manner (see also FIG. 4). By virtue of the fact that the auxiliary surfaces 5*b* are both folded in the same direction, the strut 5 illustrated in FIG. 2 has, at least in the region of the auxiliary surfaces 5*b*, a U-shaped cross-section as seen in the direction of the longitudinal axis LA of the strut 5. It is likewise feasible for the auxiliary surfaces 5*b* to be folded in opposite directions, so that, as seen in the direction of the longitudinal axis LA, a Z-shaped cross-section would be produced at least in part. By omitting auxiliary surface 5*b* or by providing merely one single auxiliary surface 5*b*, the strut 5 can also include, in a corresponding manner, an at least partially L-shaped cross-section as seen in the direction of the longitudinal axis LA. The auxiliary surfaces 5*b* serve to increase the buckling strength of the struts 5. The auxiliary surfaces 5*b* are located outside the webs 3*a*, 4*a*, so that only non-overturned regions of the main surfaces 5*a* are welded to the webs 3*a*, 4*a*.

The lower run 4 is formed by two lower run profiles 4*d*, 4*e*, wherein a structure of the lower first strut ends 5*g* and of the upper second strut ends 5*h* of the struts is produced, which differs from the arrangement shown in FIGS. 1*a* and 1*b*, and of which the structure is feasible in each case both for the first crane 1*a* and for the second crane 1*b*.

Three strut feet 5*f* are formed on the lower first strut end 5*g* of the strut 5, in that two lower apertures 5*e* for receiving the webs 4*a* of the lower run 4 are provided on the lower first strut end 5*g* in the main surface 5*a*. The lower apertures 5*e* are formed as substantially rectangular slots that each extend at the same spaced interval on the right and left with respect to the longitudinal axis LA and in parallel therewith in the main surface 5*a*. Accordingly, the main surface 5*a* extends between the slot-shaped lower apertures 5*e* likewise in a rectangular manner to the lower first strut end 5*g* and forms at this location third central strut foot 5*f*. The two lower apertures 5*e* are spaced apart from one another by the central strut foot 5*f*. In each case, one of the upwardly pointing webs 4*a* of the lower run profiles 4*d*, 4*e* is inserted into one of the lower apertures 5*e*, so that each of the slot-shaped apertures 5*e* can lie with its upper end on one of the webs 4*a*. However, in this case the two outer strut feet 5*f* do not lie on the flanges 4*f* of the lower run profiles 4*d*, 4*e*.

The two lower apertures 5*e* in FIG. 2 are formed to be substantially complementary to the webs 4*a* of the respective lower run profile 4*d*, 4*e* of the lower run 4 and have dimensions suitable for receiving the webs 4*a*. In this case, the two outer strut feet 5*f* are arranged on outer sides of the two webs 4*a* and the central strut foot 5*f* is arranged between the opposite inner sides of the two webs 4*a*, so that both webs 4*a* are arranged accordingly between the outer strut feet 5*f*. In this case, the webs 4*a* lie with their inner and outer sides against the longitudinal sides of the lower apertures 5*e* extending in the longitudinal direction LA and are welded to the struts 5 at this location. The positioning or orientation of the lower run profiles 4*d*, 4*e* with respect to each strut 5 is achieved by the corresponding arrangement of the lower apertures 5*e* in the main surface 5*a* of the strut 5.

The structure of the lower strut feet 5*f*, as shown in FIG. 2 for the second crane 1*b*, is also feasible for the first crane 1*a*, if its lower run 4 is formed by a flat profile having two webs similar to webs 4*a*.

Also, in the case of lower run 4 designed as a T-girder, lower aperture 5*e* is provided centrally or, in relation to the longitudinal axis LA, in a centered manner on the lower first strut end 5*g* in the main surface 5*a* of the strut 5 and has a cross-section that is mirror-symmetrical in relation to the longitudinal axis LA and which, starting from the lower first strut end 5*g*, tapers upwards approximately in a trapezoidal manner, and terminates with a rectangular slot adjoining it. The lower aperture 5*e* is thus formed to be substantially complementary to the web 4*a* and has dimensions that are correspondingly suitable for receiving the webs 4*a*, whereby a positive-locking connection can be produced between the lower run 4 and the strut 5 by means of the lower aperture 5*e*.

The upwardly pointing web 4*a* of the T-shaped lower run 4 is inserted into the lower aperture 5*e*, so that the lower aperture 5*e* lies with its slot-shaped upper end on the web 4*a*. In this case, the strut feet 5*f* lie on the flange 4*f* of the lower run 4 and are welded to the flange 4*f* in each case by means of horizontally extending weld seams S. Moreover, in this case the strut feet 5*f* lie, with longitudinal sides of the lower aperture 5*e* extending in the longitudinal direction LA, against outer sides of the web 4*a* extending in parallel therewith, and are welded at this location to the web 4*a* likewise by means of weld seams S.

Two strut arms 5*j* are formed on the upper second strut end 5*h* in the region of the upper corners of the struts 5, in that upper aperture 5*i* having a substantially rectangular cross-section is provided in the main surface 5*a* centrally on the upper second strut end 5*h* and in a centered manner in relation to the longitudinal axis LA of the strut 5. The upper aperture 5*i* extends, starting from the upper second strut end 5*h*, in parallel with the longitudinal axis LA, wherein the opposite longitudinal sides of the upper aperture 5*i* extends at the same spaced interval on the right and left of the longitudinal axis LA. As seen transversely with respect to the longitudinal axis LA, the upper aperture 5*i* is dimensioned in such a manner that at least the two vertically downwards pointing webs 3*a* of the two upper run profiles 3*d*, 3*e* can be inserted or pushed into the upper aperture 5*i*. However, in order to ensure that at the ends of the crane girders 2 a stiffening rib 12*c* of the adapter 12 can be pushed between the mutually facing inner sides of the webs 3*a* (see also FIG. 4), the upper apertures 5*i* of the struts 5 are preferably dimensioned to be correspondingly wider in dependence upon the thickness of the stiffening rib 12*c*. It is also preferable that the webs 3*a* and the stiffening ribs 12*c* are approximately the same thickness, so that, as seen transversely with respect to the longitudinal axis LA of the strut 5, the upper aperture 5*i* is approximately three times as wide as the thickness of one web 3*a* or the stiffening rib 12*c*.

It is also evident in FIG. 2 that the webs 3*a* of the two upper run profiles 3*d*, 3*e* lie with their outer sides facing the longitudinal sides of the upper aperture 5*i* against the longitudinal sides and that at that location a welding connection is established along the weld seams S. A further welding connection is provided between the upper run 3 and the upper second strut ends 5*h*, in particular in the form of horizontal weld seams S between the strut arms 5*j* and the flanges 3*c* of the upper run profiles 3*d*, 3*e*, which flanges lie on the end sides of the strut arms pointing in the direction of the longitudinal axis LA.

Instead of being formed from the two upper run profiles 3*d*, 3*e*, the upper run 3 can also be formed by flat profile formed in a similar manner to the optional flat profile described above with reference to the lower run 4 of the crane girder 2 of the first crane 1*a*, and therefore can be formed in one piece.

As an alternative to the illustration in FIG. 2, it is also feasible that, similar to the lower apertures 5*e*, two upper apertures 5*i* are provided instead of only one upper aperture 5*i*. The main surface 5*a* can then extend both between the lower apertures 5*e* and the upper apertures 5*i* in the direction of the upper second strut end 5*h* and form a central third strut arm 5*j* at this location. In particular, the central strut arm 5*j* formed by the main surface 5*a* can drop back at this location with respect to the end sides of the strut feet 5*f* or the ends sides of the two outer strut arms 5*j* as seen in the direction of the longitudinal axis LA, if the apertures 5*e*, 5*i* include at least one slot-shaped cross-section that is deep enough to receive or position the webs 3*a*, 4*a* of the upper and lower runs 3, 4.

As already indicated in FIG. 1*a*, the upper second strut end 5*h* can also be provided with two upper apertures 5*i*, each having a rectangular cross-section in the longitudinal sides of the main surface 5*a*. The longitudinal sides are set back in a stepped or shoulder-like manner by the upper apertures 5*i* in the region of the upper corners and in the direction of the longitudinal axis LA. Accordingly, the longitudinal sides of the main surface 5*a* are spaced less far apart from one another in the region of these shoulder-like upper apertures 5*i* than in the region of the folds of the auxiliary surfaces 5*b*. In this case, the upper apertures 5*i*, starting from the upper second strut end 5*h* in the direction of the longitudinal axis LA, are preferably dimensioned such that they correspond approximately to the length of the webs 3*a* of the upper run profiles 3*d*, 3*e*. The offset of each longitudinal side transverse to the longitudinal axis LA corresponds approximately to the thickness of one of the webs 3*a*. The upper run profiles 3*d*, 3*e* are easily connected in a positive-locking manner to the struts 5 using the laterally arranged upper apertures 5*i*, and thereby oriented with respect to one another, in that the webs 3*a* thereof are placed with their inner sides, facing the strut 5, against the set-back longitudinal sides in the upper apertures 5*i*. Then, by forming corresponding weld seams S the upper run profiles 3*d*, 3*e* are welded to the struts 5. In this case, the flanges 3*c* of the upper run profiles 3*d*, 3*e* lie with the end side—pointing in the direction of the longitudinal axis LA—of the upper second strut end 5*h* preferably in a horizontal plane.

It is also essentially feasible that in the case of the second crane 1*b* the struts 5 do not have any strut feet 5*f* formed thereon. Instead, the lower first strut end 5*g* can be provided in the longitudinal sides of the main surface 5*a* with two laterally arranged lower apertures 5*e* that form shoulders and against which the webs 4*a* of the lower run 4 lie with their inner sides and are welded.

For the second crane 1*b*, which is designed as a double-girder overhead crane, the webs 3*a* of the upper run profiles 3*d*, 3*e* are arranged preferably closer to one another and thus less far apart from the longitudinal axes LA of the struts 5 than the webs 4*a* of the lower run profiles 4*d*, 4*e*. As a result, the upper run profiles 3*d*, 3*e* of each upper run 3 of the two crane girders 2 can be connected to one another by the rail 13—likewise illustrated in FIG. 2—on upper sides facing away from the webs 3*a*. Therefore, in order to connect the upper run profiles 3*d*, 3*e*, which are arranged horizontally next to one another, a corresponding rail 13 is welded on the upper sides of the upper run profiles 3*d*, 3*e*.

The rails 13 have a rectangular cross-section and form on their upper sides one of the running surfaces 13*a* for the travelling mechanisms, not illustrated here, of the crane trolley 9. Each rail 13 is arranged preferably centrally or in a centered manner with respect to the two parallel webs 3*a* of the corresponding upper run profiles 3*d*, 3*e* and thus also in a centered manner with respect to the longitudinal axis LA of the strut 5. Moreover, the rail 13 is dimensioned in such a manner that it bridges the spaced interval between the webs 3*a* inserted into the upper aperture 5*i* and can be welded to the flanges 3*c* of the upper run profiles 3*d*, 3*e* along the longitudinal direction LR of the crane girder 2.

In one possible embodiment, the total length of strut 5 is 890 mm. In this case, the webs 3*a*, 4*a* of the upper and lower runs 3, 4 are each inserted with an insertion length of 80 mm into the apertures 5*e*, 5*i* or are welded to the longitudinal sides of the apertures 5*e*, 5*i* over the length. The spaced interval between the apertures 5*e*, 5*i*, which receive the webs 3*a*, 4*a*, and the auxiliary surfaces 5*b*, i.e. the length of the membrane joints formed in this region, is then 100 mm in each case. Accordingly, the auxiliary surfaces 5*b* have an auxiliary surface length of 530 mm in relation to the longitudinal axis LA, i.e. auxiliary surfaces 5*b* extend in their longitudinal direction over the auxiliary surface length of 530 mm.

The auxiliary surface lengths are thus preferably in a range of about 40 percent to 70 percent of the total length of the strut 5 and the insertion lengths are in a range of about 5 percent to 15 percent of the total length of the strut 5.

Figure 3A:
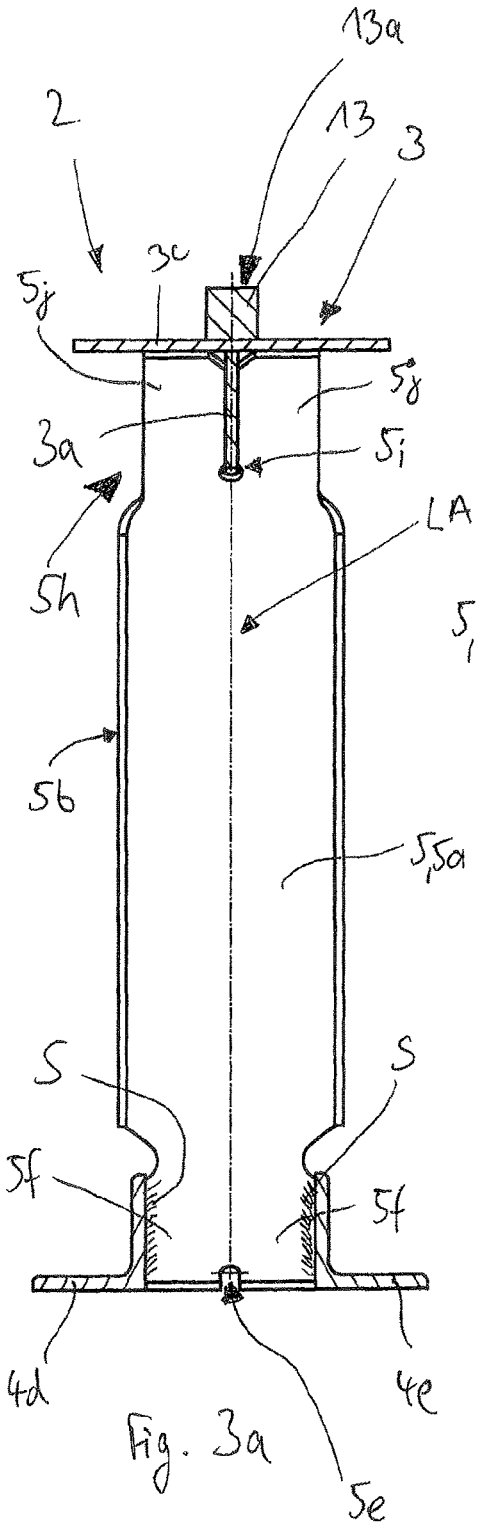
FIG. 3*a* is a cross-sectional view of an alternative crane girder for an overhead crane designed as a single or double-girder crane.
Figure 3B:
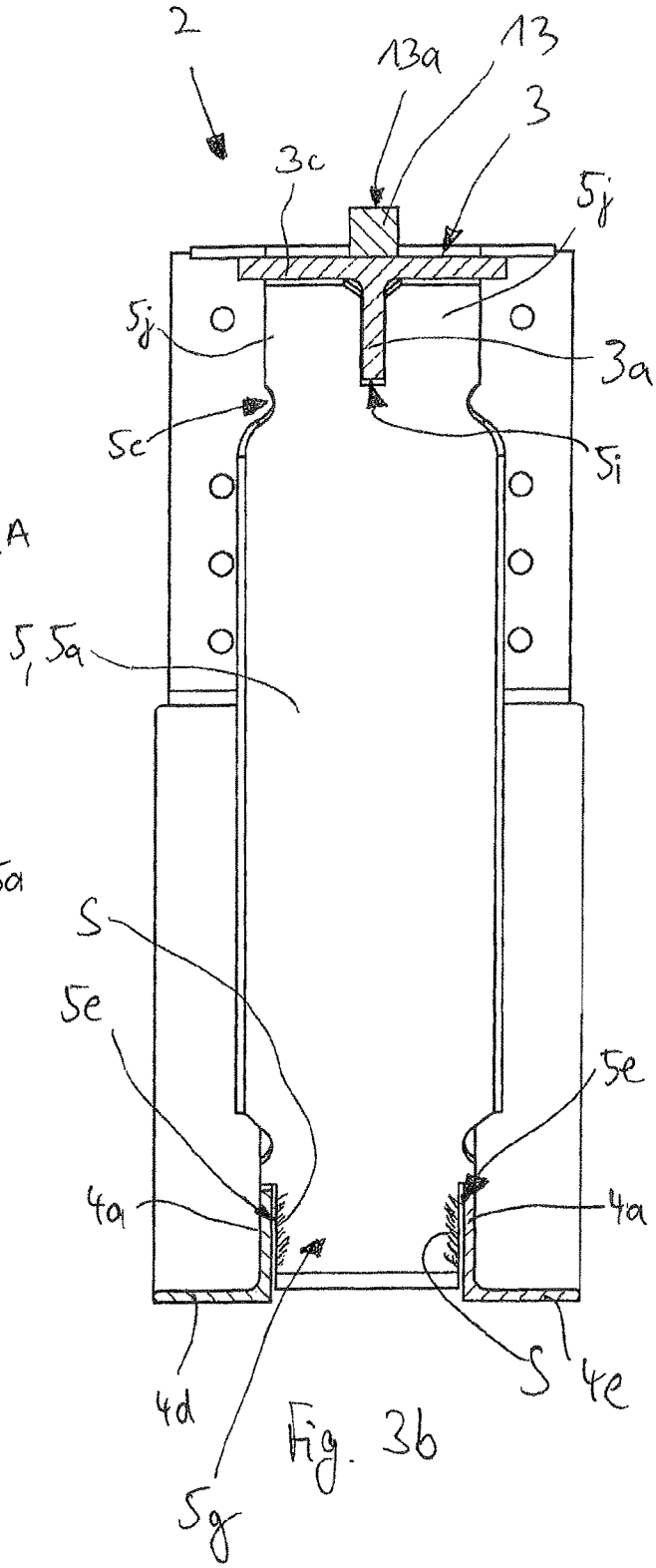
FIG. 3*b* is a cross-sectional view of another alternative crane girder for an overhead crane designed as a single or double-girder crane.

FIGS. 3*a* and 3*b* show in each case a further cross-sectional view of one of the two crane girders 2 for an overhead crane that is designed as a double-girder crane. The upper runs 3 and lower runs 4, which are illustrated and are described hereinafter and thus also the struts 5 and posts 6, can be formed in the same manner in an overhead crane that is designed as a single-girder overhead crane.

The upper run 3 of the crane girder 2 is formed in each case in one piece as a T-girder having vertically oriented web 3*a* and horizontally oriented flange 3*c*. The web 3*a* points downwards in the direction of the lower run profiles 4*d*, 4*e* of the lower run 4 and is inserted in each case into the slot-shaped upper aperture 5*i* of the struts 5 that extends in the main surface 5*a* thereof centrally along the longitudinal axis LA in the direction of the lower run 4 and hereby forms the two strut arms 5*j*. The upper apertures 5*i* correspond in terms of their structure to the lower apertures 5*e* described above in conjunction with lower run 4 designed as a T-girder, and are formed substantially in the shape of a slot having a rectangular cross-section.

In both of FIGS. 3*a* and 3*b*, the rail 13 is welded centrally on the flange 3*c* on the side facing away from the web 3*a*.

The upper aperture 5*i* shown in FIG. 3*a* differs from the one shown in FIG. 3*b* by virtue of the fact that its end facing towards the lower run 4 widens in drop-shaped manner with a roundish or bulbous progression. In contrast, the corresponding end of the upper aperture 5*i* shown in FIG. 3*b* is substantially rectangular and formed without any widening. Furthermore, in FIG. 3*a* in the region of the upper second strut end 5*h* the struts 5 do not have any upper recesses 5*c* provided therein which in contrast, e.g. also in the strut 5 shown in FIG. 3*b*, are arranged between the strut arms 5*j* and the folded auxiliary surfaces 5*b*. In FIG. 3*a*, the auxiliary surfaces 5*b* thus directly adjoin the longitudinal sides of the strut arms 5*j*.

Furthermore, FIG. 3*b* shows on the lower first strut end 5*g* of the strut 5 lateral lower apertures 5*e*, against which the lower run profiles 4*d*, 4*e* are placed and welded with their vertically oriented webs 4*a*. The statements already made above for lateral upper apertures 5*i* apply accordingly in this case.

Figure 4:
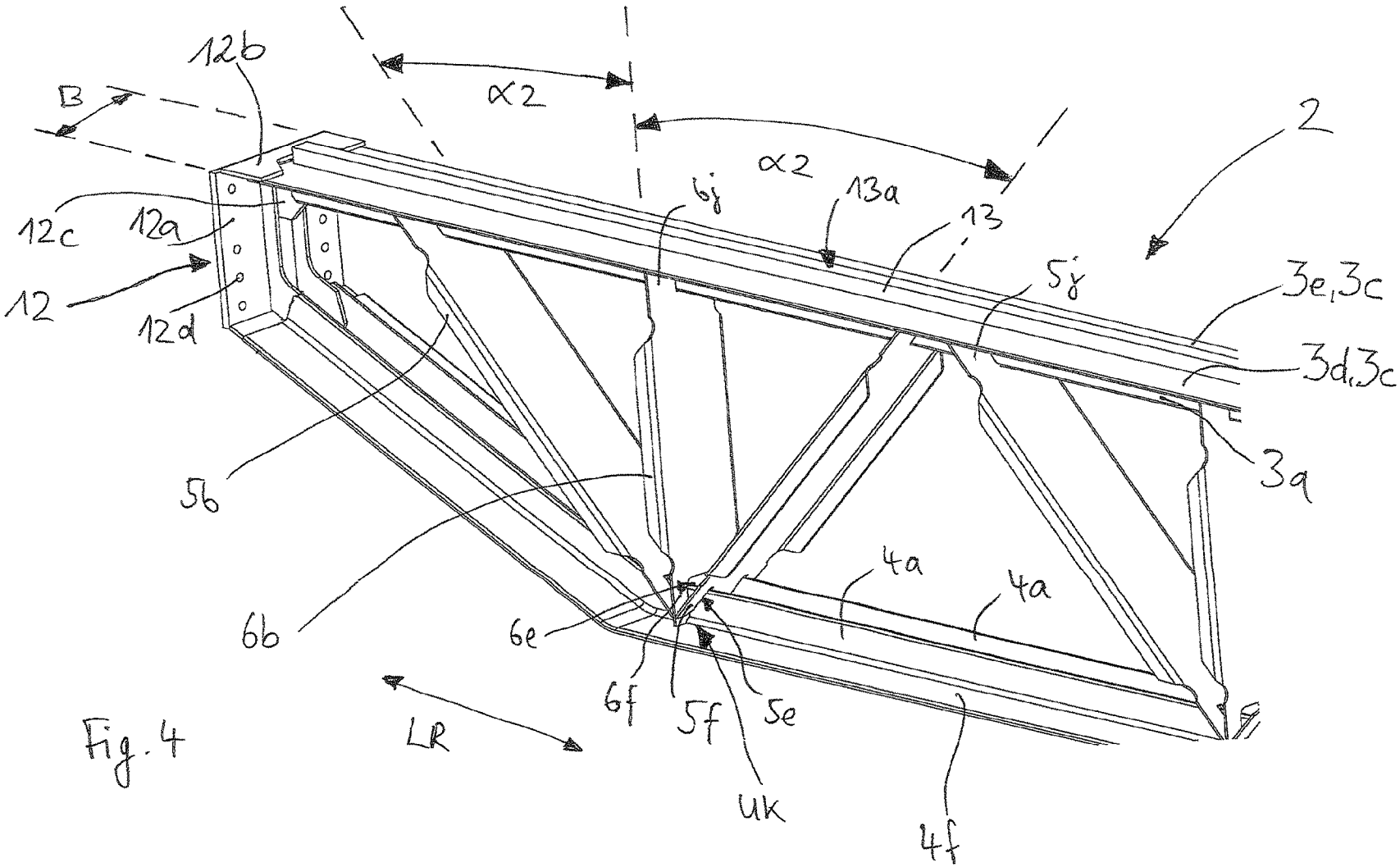
FIG. 4 is a perspective view of one end of one of the crane girders shown in FIG. 1*b*.

FIG. 4 shows a perspective view of one end of one of the two crane girders 2 for the second crane 1*b* shown in FIGS. 1*b* and 2 with one of the two adapters 12 that are arranged on both of the opposite ends. The crane girder 2 is designed as a trussed girder having upper run 3 composed of two upper run profiles 3*d*, 3*e*, and having lower run 4 composed of two lower run profiles 4*d*, 4*e*. The rail 13, which extends in the longitudinal direction LR, is welded on the flanges 3*c* of the upper run profiles 3*d*, 3*e* centrally in relation to the width of the crane girder 2. Also apparent are two struts 5 that are positioned in each case at the second setting angle $\alpha 2$ with respect to laminar post 6 and come together therewith at a lower node point UK on the lower run 4. The lower run 4 or the lower run profiles 4*d*, 4*e* thereof extend, in the region of the ends of the crane girder 2 in each case after the first or last strut 5, in a manner guided diagonally upwards in the direction of the upper run 3.

FIG. 4 also shows the trapezoidal formation of the auxiliary surfaces 5*b* of the struts 5*b* that are folded from the main surfaces 5*a* and the corresponding auxiliary surface 6*b* of the laminar post 6. The auxiliary surfaces 5*b*, 6*b* are arranged outside the webs 3*a*, 4*a* of the upper and lower runs 3, 4 and extend in a vertical plane, which includes the longitudinal direction LR of the crane girder 2.

In order to adjust the desired length L of the crane girders 2, the adapter 12 is placed against the upper run 3 and the lower run 4, oriented in the longitudinal direction LR and welded.

As already indicated in FIG. 2, FIG. 4 illustrates the stiffening rib 12*c* that is arranged on the connecting plate 12*a* or on a head plate 12*b* connected thereto at a right angle. The stiffening rib 12*c* is formed in a flat and planar manner and extends, starting from the connecting plate 12*a*, diagonally upwards with respect to the head plate 12*b*. When the adapter 12 is slid onto the crane girder 2, the stiffening rib 12*c* is pushed between the webs 3*a* of the upper run profiles 3*d*, 3*e* and is welded thereto. Accordingly, FIG. 4 indicates that the webs 3*a* of the upper run 3 are not oriented in each case in a vertically flush manner with the webs 4*a* of the lower run 4, but rather are spaced less far apart from one another in the horizontal direction than the webs 4*a*. For this purpose, in each strut 5 the upper aperture 5*i* shown in FIG. 2 is dimensioned correspondingly, in particular such that the stiffening rib 12*c* can be pushed between the two webs 3*a* protruding into the upper aperture 5*i*.

Moreover, FIG. 4 shows the first lower node point UK which, starting from the illustrated end of the crane girder 2, is located on the lower run 4 and on which the first two struts 5 and the first post 6, which are each designed in a laminar manner, come together. In the region of the lower node point UK, each of the two struts 5 together with the post 6 forms one of the second setting angles $\alpha 2$. The two outer strut feet 5*f* as well as the post feet 6*f* lie against the outer sides of the webs 4*a* of the lower run 4.

However, the post 6 includes on its lower first post end 6*g* one rectangular lower aperture 6*e* and thus two outer post feet 6*f*, against the inner mutually facing longitudinal sides of which the webs 4*a* lie with their outer sides. Therefore, a dedicated lower aperture 6*e* is not provided in the post 6 for each web 4*a*.

In contrast, the lower first ends 5*g* of the struts 5 have two lower apertures 5*e* formed thereon, of which each receives one of the webs 4*a*. However, the upper second strut ends 5*h* and the second upper post end 6*h* have a similar structure with merely one upper aperture 5*i* or 6*i*, into which the webs 3*a* of the upper run profiles 3*d*, 3*e* are inserted and against the inner sides of which the webs 3*a* lie. Accordingly, the strut arms 5*j* or post arms 6*j* formed by these upper apertures 5*i*, 6*i* lie in a similar manner to the two outer strut feet 5*f* or the post feet 6*f* against the outer sides of the webs 3*a* of the upper run 3.

Essentially, it is also possible that the lower first strut ends 5*g* are formed in a similar manner to the lower first post ends 6*g* with only one rectangular lower aperture 5*e* and accordingly with only two outer strut feet 5*f*, so that the struts 5 are oriented with respect to the lower run 4 by the longitudinal sides of the merely one lower aperture 5*e*.

The invention claimed is:

1. A crane comprising: at least one trussed crane girder that extends horizontally in a longitudinal direction and comprises struts that connect an upper run and a lower run together, wherein the crane girder is adapted to support a movable crane trolley having a lifting gear, wherein the struts are laminar in shape, each strut comprising a main surface that extends transversely with respect to the longitudinal direction of the at least one crane girder and that at least one aperture is provided on the main surface at a first or second strut end of the struts wherein the lower run or the upper run lies against the main surface.

2. The crane of claim 1, wherein the struts are positionable in a positive-locking manner relative to the lower run or the upper run using the aperture.

3. The crane of claim 2, wherein the struts are connected to the lower run or the upper run using the aperture.

4. The crane of claim 2, wherein the struts are welded to the lower run or the upper run in the region of the aperture.

5. The crane of claim 2, wherein the lower first strut end is provided with a lower aperture, against which the lower run lies, and the upper second strut end is provided with an upper aperture against which the upper run lies.

6. The crane of claim 1, wherein the struts are connected to the lower run or the upper run using the aperture.

7. The crane of claim 6, wherein the struts are welded to the lower run or the upper run in the region of the aperture.

8. The crane of claim 6, wherein the lower first strut end is provided with a lower aperture, against which the lower run lies, and the upper second strut end is provided with an upper aperture against which the upper run lies.

9. The crane of claim 1, wherein the struts are welded to the lower run or the upper run in the region of the aperture.

10. The crane of claim 9, wherein the lower first strut end is provided with a lower aperture, against which the lower run lies, and the upper second strut end is provided with an upper aperture against which the upper run lies.

11. The crane of claim 1, wherein the lower first strut end is provided with a lower aperture against which the lower run lies, and the upper second strut end is provided with an upper aperture against which the upper run lies.

12. The crane of claim 1, wherein the upper run and the lower run each comprise at least one vertical web and the web of the upper run lies against an upper aperture and the web of the lower run lies against a lower aperture.

13. The crane of claim 12, wherein precisely one aperture is provided for each web.

14. The crane of claim 12, wherein either (i) the upper run comprises two of said webs and a common upper aperture is provided in each strut so that the webs of the upper run can be inserted into the common upper aperture, or (ii) the lower run comprises two of said webs and a common lower aperture is provided in each strut so that the webs of the lower run can be inserted into the common lower aperture.

15. The crane of claim 12, wherein the web of the lower run or the web of the upper run is welded to at least one longitudinal side of the corresponding aperture, which longitudinal side extends in parallel with a longitudinal axis of the struts.

16. The crane of claim 1, wherein either (i) the upper run comprises two upper run profiles each having a web, or (ii) the lower run comprises two lower run profiles each having a web.

17. The crane of claim 1, wherein the struts comprise at least one auxiliary surface that is folded at a right angle from the main surface.

18. The crane of claim 1, wherein at least one of the apertures is formed in the shape of a slot and is arranged between the longitudinal sides of the respective main surface.

19. The crane of claim 1, wherein at least two of the apertures are formed in the shape of a shoulder and are arranged opposite one another on the longitudinal sides of the respective main surface.

20. The crane of claim 1, wherein the upper run and the lower run are connected to one another by a plurality of posts arranged along the longitudinal direction of the crane girder, wherein the posts are laminar in shape and comprise at least one aperture.

* * * * *